US007267065B1

(12) United States Patent
Short

(10) Patent No.: US 7,267,065 B1
(45) Date of Patent: Sep. 11, 2007

(54) SAILING VESSEL WITH LATEEN SAIL RIGGING

(76) Inventor: Robert J. Short, 727 Emerald Bay, Laguna Beach, CA (US) 92651

( * ) Notice: Subject to any disclaimer, the term of this patent is extended or adjusted under 35 U.S.C. 154(b) by 0 days.

(21) Appl. No.: 11/408,427

(22) Filed: Apr. 21, 2006

(51) Int. Cl.
*B63H 9/00* (2006.01)
*B63H 9/06* (2006.01)

(52) U.S. Cl. ..... 114/39.29; 114/39.32; 114/90; 114/102.1; 114/102.29

(58) Field of Classification Search ..... 114/39.21, 114/39.29, 39.32, 90, 91, 102.1, 102.29
See application file for complete search history.

(56) References Cited

U.S. PATENT DOCUMENTS 3,141,435 A * 7/1964 Moffitt, Jr. ..... 114/39.26
3,195,494 A 7/1965 Robin
3,693,571 A 9/1972 Hiscock
3,874,313 A 4/1975 Doepner
3,968,765 A 7/1976 Menegus
4,047,493 A 9/1977 Menegus
4,365,570 A 12/1982 Jamison
4,466,372 A 8/1984 Rudloff
4,474,126 A 10/1984 King
4,603,648 A * 8/1986 Berge ..... 114/39.27
4,799,443 A 1/1989 Vogel
5,231,943 A 8/1993 Benze
5,392,726 A 2/1995 Benze
5,423,274 A 6/1995 Benze
5,601,044 A 2/1997 Hara
5,873,588 A * 2/1999 Swetish ..... 280/213
6,116,177 A 9/2000 Conant
6,959,659 B1 * 11/2005 Burrell ..... 114/39.27

* cited by examiner

*Primary Examiner*—Sherman Basinger
(74) *Attorney, Agent, or Firm*—Gene Scott; Patent Law & Venture Group

(57) ABSTRACT

A lateen rigged sailing vessel having a mast; a luffspar; a boom; a pair of lateral struts; and a lateen sail, has a lower end of the mast mounted forward on the vessel and positioned on the vessel's longitudinal center line in a canted fashion raked aft. The boom is rotationally supported in a lower journal fixedly engaged medially on the vessel at the center line. The luffspar is joined pivotally with a forward end of the boom and, when rigged for sailing is positioned below and in parallel with the mast. The luffspar is rotationally supported in an upper journal wherein the upper journal, upper end of the mast, and upper ends of the pair of lateral struts are all engaged in a common fixture held in place by the mast and the lateral struts. The upper and lower journals are arranged on a common journal center line. The lower ends of the lateral struts are engaged with the vessel at the port and starboard gunnels. The sail is engaged along a luff edge with the luffspar and along a toe edge with the boom.

8 Claims, 1 Drawing Sheet

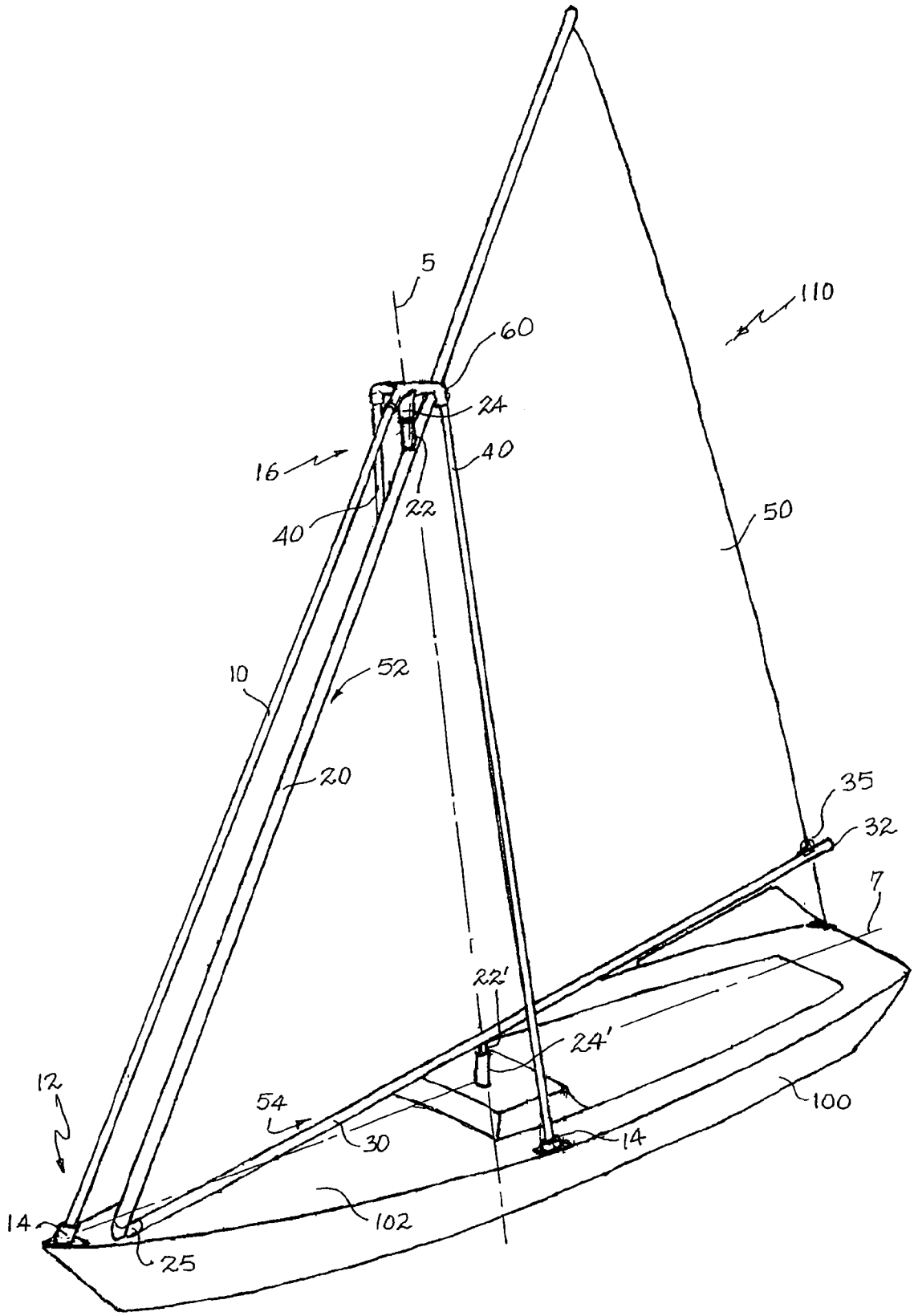
5
110
60
24
16
40
40
22
50
10
52
20
35
32
7
22'
24'
12
54
30
14
100
14
102
25

SAILING VESSEL WITH LATEEN SAIL RIGGING

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

REFERENCE TO A "MICROFICHE APPENDIX"

Not applicable.

BACKGROUND OF THE INVENTION

1. Field of the Present Disclosure

This disclosure relates generally to a triangular sail called a lateen sail and a method of rigging it on a sailboat.

2. Description of Related Art Including Information Disclosed Under 37 CFR 1.97 and 1.98

Spurr. D, "Good Old Boat" magazine, PP 14-19, "The World According to Hoyt" discloses a lateen rigged sailing vessel with side struts, boom, luffspar and sail all mounted on a single rotating swivel. Rudloff, U.S. Pat. No. 4,466,372, discloses an improved lateen rigged sailing board that combines a sailing board with a mast mounted thereon which is swivelly mounted to the upper surface of the sailing board, and which is provided with means to prevent the mast from completely falling forward. The mast is particularly configured with a wishbone or hoop-like section therein, through which the lateen sail is passed. The boom of the sail is secured within the lower portion of the hoop-like section, while the gaff of the sail is hoisted toward the upper portion of the hoop-like section by a halyard that may conveniently pass through the upper end of the hoop-like section and be secured by a simple expedient of a cam cleat. The arrangement is such that the mast will allow the center-of-effort of the sail to be adjusted relative to the sailing board and allow the entire unit to be tacked through the wind and move upward. Robin, U.S. Pat. No. 3,195,494, discloses a sailing vessel, a sail and a sail rig, the sail comprising a generally triangular sail membrane, strut means attached to the aft end of the boat and extending upwardly and forwardly therefrom, a generally triangular frame comprising a base member and two strut members fixed together in generally triangular relation, the strut members being fixed together at a first end thereof defining an apex and each of the strut being fixed to the base member at an opposite end thereof from the other, the apex end of the struts being fixed to the strut means at its upper end, a universal joint fixed to the base member at an intermediate position thereon, a traveler connected to the universal joint, guide members on the boat generally parallel to the keel thereof and means on the traveler to guide it on the guide members, and means to rotate the universal joint relative to the traveler whereby the sail membrane may be rotated relative to the vessel and the bottom of the sail may be moved forward and aft relative to the vessel. Hiscock, U.S. Pat. No. 3,693,571, discloses a sail rig adapted for use with any sail propelled vehicle which permits both the tack and the clew of the sail to be positioned independently relative to the body of the vehicle (i.e. the hull). This arrangement permits the vehicle to be sailed much closer into the true wind than has heretofore been possible. In the preferred embodiment, the head or peak of a generally symmetrical generally triangular sail is rotatably fastened to a mast structure which mast structure is otherwise out-of-contact with the sail and the tack is fastened to a thrust spar which in turn is pivotally attached to the deck of the vehicle. Preferably the luff of the sail is provided with a stiffening member which may be a curved luff spar where the luff itself is curved and the foot of the sail with a boom. Manipulation of the thrust boom permits the leading edge or luff of the sail to be positioned at any angle of arc up to 90.degree. or beyond on either side of the fore and aft centerline of the hull. The position of the clew is manipulated in the normal manner for a fore and aft rig by a main sheet. Menegus, U.S. Pat. No. 3,968,765, discloses an apparatus for rotatably mounting a sail on racing yachts, sailboats and sailsleds, which includes a step adapted to be mounted on the hull of the craft, a boom, rigging connecting the sail to the boom, adapted to enable setting of the sail-to-boom orientation, and means for connecting the boom to the step so that the boom, sail and rigging are substantially freely rotatable about the step, and so that the orientation of the sail is maintained at a substantially constant angle with respect to the direction of the shifting apparent wind, to enable the sail to respond directly to shifting winds without requiring manual supervision, in order to provide maximum thrust with minimum drag for substantially increased racing yacht speed capabilities. A keel is connected to the bottom of the hull to rotate about a vertical axis through the abaft portion of the keel, in order to minimize racing yacht heeling and hydrodynamic drag. A rudder is rotatably connected astern, which includes a horizontal stabilizing fin oriented thereon so as to minimize racing yacht bucking by damping the yacht's response to choppy seas. Menegus, U.S. Pat. No. 4,047,493, discloses an apparatus for mounting a jibsail and a mainsail on a sloop, the structure including a step assembly bedded to the hull and supporting conventional roller and ball bearings; a mast spreading the mainsail; a generally horizontal boom located close above deck and rotating freely about the step; a forespar rotatable about its own axis and extending from high up on the mast to said boom, spreading the jibsail; and rigging connecting the jib and mainsail with said boom. The spars, sails, and cord rigging are freely rotatable on the bearings as a unit about the step as the wind deviates in direction. The rotatable spar-frame allows the sails to respond directly and accurately to shifting winds without requiring repeated manual adjustments, so that the orientations of the sails with respect to the direction of the apparent wind may be voluntarily set, and once set remain constant while the sails operate below stall, in order, first, to provide maximum thrust with minimum drag for sailing to windward and, second, to provide for automatic going about and jibing and sailing on any possible point by manning only the helm. Jamieson, U.S. Pat. No. 4,365,570, discloses a sail portion of a sailboard that has upper and lower sections, and the lower edge (foot) of the upper section is lapped relative to the upper edge (head) of the lower section. Apparatus is provided to cause the lower edge to be on the upwind side of the upper edge, regardless of the tack that the boat is on. Such apparatus comprises a rotating boom which rotates through the sail, in such manner as to shift from one side of the sail to the other and also cause the above-described lapped relationship to occur in either tack. The disclosure further relates to a combination of the sail system with the board, to the method of achieving the indicated lapped relationship and of rotating the boom, and to other important features. King, U.S. Pat. No. 4,474,126, discloses a sailing rig for use on a sailboat comprising a sail formed in the shape of two approximately ellipsoidal portions with a free-standing mast being rotatable on its vertical axis, the mast being curved near its top from the vertical axis of rotation of the mast so that the sail, when the sailboat is close-hauled, folds around the mast and when the sailboat runs before the wind, the sail unfolds and opens to fly free of the mast. Vogel, U.S. Pat. No. 4,799,443, discloses a novel rigging for a sailboat in which the mainsail is mounted between a luff boom and a foot boom, the luff boom being attached to the top of the mast by a fitting that allows rotation at least about a vertical axis parallel to the mast and about a tilt axis normal to the mast such that the luff boom can tilt out of the vertical. The fitting is joined to the luff boom at a pivot point above the center of effort of the sail, and not necessarily at its head. A tack sheet and a clew sheet restrict the tilt of the luff boom and its rotation around the mast. A jib sail, too, may be tiltably mounted by attaching it to a luff boom which is suspended at its head from a high point on the mast. The mast may be retractable or extendable and either luff boom may be given a streamlined cross section. Doepner, U.S. Pat. No. 3,874,313, discloses a sailing rig for sailing boats that comprises a main boom and a mast taken out of its socket. The foresail and the main sail are combined to form a single triangular sail and a sloping mast is provided at the leading edge of said combined said and connected thereto independently of the hull of the boat. The substantially horizontal main boom is rotatably mounted to swing about a vertical axis in the socket for the mast in the hull and the forward end of the main boom terminates in a fork-shaped swing joint embracing the bottom end of the mast which extends through the fork-shaped swing joint downwards to below the sweep of the main boom, where its free end is connected by block and tackle and a spring to the fore part of the main boom. Benze, U.S. Pat. No. 5,231,943, discloses a plan for a sail of a sailing craft such as a sailboat, an iceboat and a land yacht having a hull. At least one mast is mounted on an end of the hull and the mast angles upwardly over the hull. A boom is pivotably mounted approximately amidships of the hull. The boom is rotatable through 360.degree. about the mounting point, and the ends of the boom avoid contact with the at least one mast. A triangular sail has a lower edge connected to the boom and an upper corner releasably connected to the top of the at least one mast. The boom, preferably, has an upper member and a lower member. The upper member is rotatable, and the sail may be roller reefed about the upper member. A steering system for the vehicle is provided which is collocated with the controls for the sail whereby the vehicle may be controlled by one individual at a single location. In a catamaran type sailboat, a control ring is connected to the boom whereby pivotal and rotational movement of the sail may be controlled by a person seated on the hull. Benze, U.S. Pat. No. 5,392,726, discloses a sailing craft having a center hull, a port hull and a starboard hull. The port and starboard hulls are adjustably connected to the center hull by bridge beams such that the port starboard hulls may be disposed adjacent to, or outward from, the center hull. An inverted U-shaped mast has legs angled outwardly and connected to the port and starboard hulls when the mast is erect and legs which are substantially parallel when the mast is stepped down for storage on the center hull. A primary boom is rotatably connected to the center hull and rotates through 360.degree. An articulating boom is pivotally connected to each of the ends of the primary boom. A sail shape boom is connected to the articulating booms by a trolley on each articulating boom. The head of a sail is connected to the top of the mast and the foot of the sail is connected to the sail shape boom. The sail and booms are rotatable through 360.degree. without contacting the mast. Sail lines connected to the edges of the sail are separated into support lines which are disposed over the surfaces of the sail and connected to wishbone spars to maintain luff and each alignment and control the sail shape by equal tensioning applied by the halyard. Benze U.S. Pat. No. 5,423,274, discloses a sailing craft that has a hull with a longitudinal midplane. A primary boom is pivotally mounted on the hull for 360.degree. continuous rotation in either direction about a central vertical axis. The primary boom is connected by lines to a sail boom. At least one angled mast is mounted to the hull and extends upwardly. The mast has a top, the top is disposed approximately above the central vertical axis of the primary boom. A sail is carried by the sail boom and extends upwardly and substantially symmetrically about the central vertical axis. The sail is supported from the top of the at least one mast. The sail boom with the sail thereon has completely free 360.degree. rotation in either direction avoiding contact with the mast. The sail has flake lines swivelably connected to the top of the mast permitting rotation of the sail and flaking of the sail. A tension device maintains tension on the top of the halyard so the sail luff becomes tight when the primary boom rotates either end forward. Hara, U.S. Pat. No. 5,601,044, discloses a sailboat that has an improved mast and boom arrangement wherein the mast is pivotally supported relative to the hull about an axis that is disposed rearwardly from the mast and close to but in front of the normal center of pressure on the sail carried thereby so as to reduce the turning moments on the hull during sailing and improve the speed performance. An improved pivotal arrangement for the boom is disclosed, as is a pivotal connection between the mast and the boom which permits the mast to be easily raised and lowered. Conant, U.S. Pat. No. 6,116,177, discloses an improved mast assembly for use on a sailing vessel that has both an upper boom and a lower boom that allows a user to control the upper section of the sail independently or in conjunction with the lower section of the sail. The mast of the assembly is positioned away from the sail thereby utilizing a wire leading edge resulting in decreased wind turbulence, increased efficiency of the sail and greater sailing control over the rig and the entire vessel.

The related art described above discloses lateen rigs. However, the prior art fails to disclose a lateen rig of the type herein described and illustrated. The present disclosure distinguishes over the prior art providing heretofore unknown advantages as described in the following summary.

BRIEF SUMMARY OF THE INVENTION

This disclosure teaches certain benefits in construction and use which give rise to the objectives described below.

The lateen sail sailing rigging, a single large triangular sail, evolved in antiquity from earlier used square sails. It provided the ability to sail toward the wind but was difficult to adjust in tacking. The so-called split rig was an improvement providing more efficient tacking. The modem "marconi" rigging evolved from the split rig still using the central vertical mast which is ubiquitous today. The prior art design of Garry Hoyt, referenced above, uses no true mast at all, but rather mounts the sail on a luffspar forward and a boom below, all of which is supported in a pivotal mounting. The present invention uses a forward mast in an improved lateen rigging. This lateen rigged sailing vessel has a mast; a luffspar; a boom; a pair of lateral struts; and a lateen sail. The lower end of the mast is mounted forward on the vessel and positioned on the vessel's longitudinal center line in a canted fashion raked aft. The boom is rotationally supported in a lower journal fixedly engaged medially on the vessel at the center line. The luffspar is joined pivotally with a forward end of the boom and, when rigged for sailing is positioned below and in parallel with the mast. The luffspar is rotationally supported in an upper journal wherein the upper journal, upper end of the mast, and upper ends of the pair of lateral struts are all engaged in a common fixture held in place by the mast and the lateral struts. The upper and lower journals are arranged on a common journal center line. The lower ends of the lateral struts are engaged with the vessel at the port and starboard gunnels. The sail is engaged along a luff edge with the luffspar and along a toe edge with the boom. The advantages of such a lateen rigging are described below.

A primary objective inherent in the above described apparatus and method of use is to provide advantages not taught by the prior art.

Another objective is to provide a sailing vessel with a large, effective and efficient single sail surface.

Another objective is to provide such a vessel that has a pivoting sail allowing optimum positioning of this full sail surface with respect to the wind without interference from its mast;

Another objective is to provide such a vessel that has a quick and simple means of hoisting, dousing and/or reducing sail.

Another objective is to provide such a vessel that has a quick and simple means of tacking and/or jibing without interference from its mast.

Another objective is to provide such a vessel that has no traditional, vertical mast causing an ineffective sail shape on one tack or a laborious and time consuming shift of spars to change tacks.

Another objective is to provide such a vessel that has no need to have a main and a jib.

Another objective is to provide such a vessel that does not suffer from the blanketing effect of the main on the jib when sailing off the wind.

Another objective is to provide such a vessel that avoids the complexities of split rigs.

Other features and advantages of the present invention will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWING(S)

Illustrated in the accompanying drawing is at least one of the best mode embodiments of the present invention In such drawing:

FIG. 1 is a perspective view of the presently described apparatus.

DETAILED DESCRIPTION OF THE INVENTION

The above described drawing FIGURES illustrate the described apparatus and its method of use in at least one of its preferred, best mode embodiment, which is further defined in detail in the following description. Those having ordinary skill in the art may be able to make alterations and modifications what is described herein without departing from its spirit and scope. Therefore, it must be understood that what is illustrated is set forth only for the purposes of example and that it should not be taken as a limitation in the scope of the present apparatus and method of use.

Described now in detail is a sailing vessel 100 with a lateen sail rigging 110. The rigging 110 is made up of six parts, namely: a mast 10, a luffspar 20, a boom 30, a pair of lateral stays or struts 40 and a lateen sail 50 as shown in FIG. 1. The mast 10, luffspar 20, boom 30, and struts 40 are each preferably a shaft or cylinder and may alternatively be round, oval, square or rectangular in cross-section, and are preferably made of a rigid material such as reinforced plastic, metal or wood. The mast 10 and the lateral struts 40 are each preferably secured to the vessel's deck 102 in sleeves 14 comprising a base fastened to the deck 102 and a tubular portion integral with the base and extending upwardly for receiving the mast 10 or one of the lateral struts 40. However, the securement of the mast 10 and lateral struts 40 may be secured to the vessel in any common and well known manner used in sailing vessels. Furthermore, the mast 10 is preferably positioned along the vessel's longitudinal center line 7 in a canted fashion, i.e., raked aft such that its upper end 16 is in a position approximately over a near vertical rod 22' integral with the boom 30 and extending downwardly therefrom. The mast 10 is preferably fitted with a halyard (not shown) to raise the luffspar 20 to a position, as shown in FIG. 1 that is nominally in line and parallel with the mast 10. Such a halyard is well known in the field of sail rigging, and would be routinely enabled by those of skill in such nautical arts. The mast 10 is restricted from lateral motion by the lateral struts 40 running from the upper end of the mast 16 downwardly to the gunnels both port and starboard and are positioned laterally in line with the rod 22'.

The luffspar 20 provides an approximately vertical integral rod 22 extending upwardly, that is fitted into an upper journal 24 for rotation. As shown in FIG. 1, the luffspar 20 and the boom 30 are joined forward so that they are able to rotate together within journals 24 and 24'. The engaging of rotating shafts or rods within journals is well known in the art and may be accomplished in a variety of ways.

The upper terminal ends of mast 10, luffspar 20 and both struts 40, are fitted into a joining fixture 60 of the type shown in the figure. The engagement of these elements with fixture 60 is such as to allow for disengagement as necessary for maintenance or replacement of parts.

Preferably, the luffspar 20 is fitted at its lower end with a luffspar/boom attachment fixture 25 which allows the boom 30 to pivot relative to the luffspar 20.

Preferably, the luffspar 20 is fitted at its lower end with a luffspar downhaul (not shown) allowing the lateen sail 50 to be pulled taught or loosened as wind conditions dictate.

Preferably, the luffspar 20 is fitted at its upper end with a luffspar outhaul (not shown) for affixing the lateen sail 50 to the upper end of the luffspar 20.

Preferably, the boom 30 is fitted at its aft end 32 with a boom outhaul attachment fixture 35 attaching the clew of the lateen sail 50 to the boom and allowing for adjustment as wind conditions dictate.

The lower journal 24' is mounted on the centerline 7 of the vessel 100 at a point plumb with the upper journal 24.

The lateen sail 50 is triangular in shape and fitted along its luff edge 52 with any conventional means to attach it to the luffspar 20. The sail 50 is fitted along its foot edge 54 with any conventional means for attaching it to the boom 30. It may be loose footed, i.e., attached only at the tack and clew of the sail or attached by standard means all along the boom 30. It is fitted at its head, tack and clew with any common means of attaching inhaul, downhaul and outhaul lines as is well known in the art.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. A fully rigged sailing apparatus comprising: a vessel having a mast; a luffspar; a boom; a pair of lateral struts; and a lateen sail; a lower end of the mast mounted forward on the vessel and positioned on the vessel's longitudinal center line in a canted fashion raked aft; the boom rotationally supported in a lower journal fixedly engaged medially on the vessel at the center line; the luffspar joined pivotally with a forward end of the boom and positioned below and in parallel with the mast, the luffspar rotationally supported in an upper journal; the upper journal, upper end of the mast, and upper ends of the pair of lateral struts engaged in a common fixture held in place by the mast and the lateral struts; the upper and lower journals arranged on a common journal center line; lower ends of the lateral struts engaged with the vessel at the port and starboard gunnels, the sail engaged along a luff edge thereof with the luffspar and along a toe edge thereof with the boom.

2. The apparatus of claim 1 wherein the lateral struts are positioned laterally in line with the lower journal.

3. The apparatus of claim 1 wherein the mast and the lateral struts are each secured to a deck of the vessel by a mounting sleeve.

4. The apparatus of claim 1 wherein the boom and the luffspar each provide a vertically oriented integral rod enabled by size and length for rotational engagement with one of the journals.

5. A lateen rigging comprising: a mast; a luffspar; a boom; a pair of lateral struts; and a lateen sail; a lower end of the mast fitted for mounting forward on a vessel in a canted fashion raked aft; the boom rotationally supported in a lower journal, for being supported medially on the vessel along a center line thereof; the luffspar joined pivotally with a forward end of the boom and positioned below and in parallel with the mast when fully rigged for sailing, the luffspar rotationally supported in an upper journal; the upper journal, upper end of the mast, and upper ends of the pair of lateral struts engaged in a common fixture held in place by the mast and the lateral struts; the upper and lower journals arranged on a common journal center line; lower ends of the lateral struts fitted for mounting at port and starboard gunnels of the vessel; the sail engaged along a luff edge thereof with the luffspar and along a toe edge thereof with the boom.

6. The apparatus of claim 5 wherein the lateral struts are positioned laterally in line with the lower journal.

7. The apparatus of claim 5 wherein the mast and the lateral struts each terminate downwardly with mounting sleeves for securement to a deck of the vessel.

8. The apparatus of claim 5 wherein the boom and the luffspar each provide a vertically oriented integral rod enabled by size and length for rotational engagement with one of the journals.

* * * * *